US010655831B2

(12) United States Patent
Clynne et al.

(10) Patent No.: US 10,655,831 B2
(45) Date of Patent: May 19, 2020

(54) LUMINAIRE WITH A REPLACEABLE EXTERIOR SENSOR MODULE

(71) Applicant: Current Lighting Solutions, LLC, East Cleveland, OH (US)

(72) Inventors: Thomas Clynne, East Cleveland, OH (US); Jonathan Robert Meyer, Shaker Heights, OH (US); Francis Beaudoin, Lachine (CA); Eric Lavigne, Lachine (CA); Thomas Knapp, East Cleveland, OH (US); Koushik Saha, Strongsville, OH (US)

(73) Assignee: Current Lighting Solutions, LLC, East Cleveland, OH (US)

( * ) Notice: Subject to any disclaimer, the term of this patent is extended or adjusted under 35 U.S.C. 154(b) by 225 days.

(21) Appl. No.: 15/692,181

(22) Filed: Aug. 31, 2017

(65) Prior Publication Data

US 2018/0087760 A1 Mar. 29, 2018

Related U.S. Application Data

(60) Provisional application No. 62/401,453, filed on Sep. 29, 2016.

(51) Int. Cl.

| | |
|---|---|
| ***F21V 23/04*** | (2006.01) |
| ***F21V 23/00*** | (2015.01) |
| ***F21S 8/08*** | (2006.01) |
| ***H05B 33/08*** | (2020.01) |
| ***H05B 47/105*** | (2020.01) |
| ***F21V 5/04*** | (2006.01) |

(Continued)

(52) U.S. Cl.

CPC ..... *F21V 23/0471* (2013.01); *F21S 8/08* (2013.01); *F21V 5/04* (2013.01); *F21V 23/009* (2013.01); *F21V 23/0442* (2013.01); *H05B 33/08* (2013.01); *F21V 23/0492* (2013.01); *F21W 2131/10* (2013.01); *H05B 47/105* (2020.01); *H05B 47/19* (2020.01)

(58) Field of Classification Search

None

See application file for complete search history.

(56) References Cited

U.S. PATENT DOCUMENTS 9,654,678 B1 * 5/2017 Fu ..... H04N 7/18
10,480,966 B1 * 11/2019 Mahaffey ..... F21V 17/10
(Continued)

*Primary Examiner* — Suezu Ellis

(74) *Attorney, Agent, or Firm* — Buckley, Maschoff & Talwalkar LLC

(57) ABSTRACT

The specification and drawings present methodology for modularly expanding sensing capabilities of a luminaire or a luminaire mounted sensing system by adding replaceable exterior sensor module(s) in a desired position in a vicinity of an existing (legacy) luminaire or a luminaire system for both inside and outside applications. For outside applications, this modular expansion may be performed while maintaining weathertight sealing integrity, e.g., waterproofing of the luminaire-sensor system/apparatus including exterior housing, exterior electrical connections, cables and any other exposed components. The embodiments described herein can provide diverse sensor capability and future expansion needs for luminaire mounted sensing systems and for processing sensor signals.

22 Claims, 11 Drawing Sheets

(51) Int. Cl.
*F21W 131/10* (2006.01)
*H05B 47/19* (2020.01)

(56) References Cited

U.S. PATENT DOCUMENTS

| | | | | |
|---|---|---|---|---|
| 2011/0188247 | A1* | 8/2011 | Huang | B01D 39/1692 362/249.02 |
| 2012/0229025 | A1* | 9/2012 | Edwards, Jr. | H05B 33/0803 315/35 |
| 2015/0259078 | A1* | 9/2015 | Filipovic | H04W 88/08 244/114 R |
| 2016/0286619 | A1* | 9/2016 | Roberts | H05B 33/0854 |
| 2017/0156189 | A1* | 6/2017 | Jayawardena | H05B 33/0884 |
| 2017/0359643 | A1* | 12/2017 | Saha | H04R 1/086 |
| 2018/0026329 | A1* | 1/2018 | Johnson | H01Q 13/20 |

* cited by examiner

LUMINAIRE WITH A REPLACEABLE EXTERIOR SENSOR MODULE

TECHNICAL FIELD

The invention generally relates to luminaires. More particularly, but not exclusively, this invention relates to modularly expanding the sensing capabilities of a luminaire mounted sensing system.

BACKGROUND OF THE INVENTION

Outdoor luminaires have begun to be pressed into service as power and mounting platforms for a variety of electronic sensor and data processing systems. The sensors used in these systems can be selected from one or more of a wide variety of devices including, but not limited to, cameras, microphones, environmental sensors (such as temperature, pressure, humidity, etc.), accelerometers, gyroscopes, antennas, and many others. These types of sensing technologies usually require electrical power input and a data interface in order to provide their data to the processing capability of the system. They may also require a means to provide mechanical support and protection from the weather.

Due to the nature of their placement outdoors, exposure to a variety of weather conditions must be considered when contemplating the construction of such a luminaire sensor system. A variety of traditional sealing and weatherproofing methods exist for the creation of a housing that can contain the electronics portion of the system, and standard methods exist for protecting optical elements, such as protective windows and/or performance enhancement coatings for use with cameras and lenses.

BRIEF DESCRIPTION OF THE DRAWINGS

Features and aspects of the present disclosure will become better understood when the following detailed description is read with reference to the accompanying drawings, in which components may not be drawn to scale, and in which like characters represent like parts throughout the drawings, wherein.

DETAILED DESCRIPTION

Figure 1A:
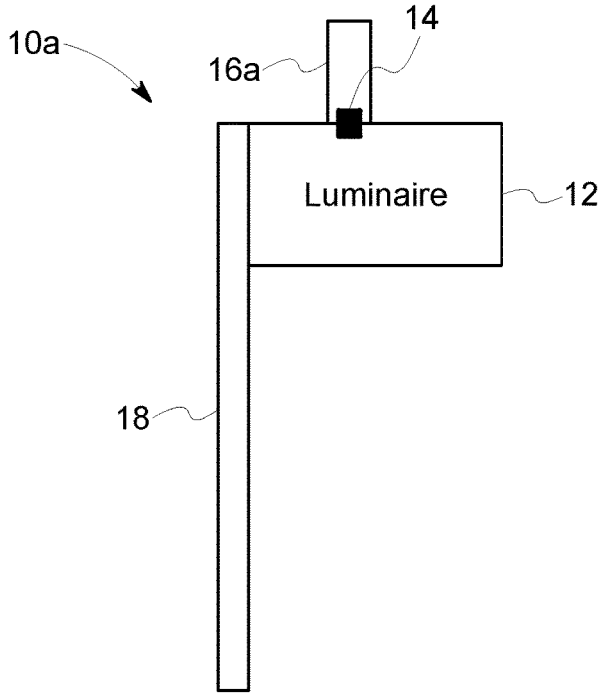
FIGS. 1A and 1B are various exemplary views of a luminaire on a mounting pole including a replaceable exterior sensor module according to an embodiment of the invention.

In various applications, a luminaire can be utilized as a mechanical mounting and power source for a sensor system. It is desirable to be able to further expand the sensing capabilities of luminaire-sensor systems to include, for example, additional advanced sensors which may be developed in the future, or that may need to be replaced or changed over the life of the sensor system. For example, an improved/advanced version of a sensor may be substituted for or replace a broken sensor in the luminaire.

A luminaire-sensor system and/or apparatus and a corresponding methodology are presented herein for modularly expanding the sensing capabilities of a luminaire or a luminaire mounted sensing system by adding one or more replaceable exterior sensor module(s) in a desired position (or desired positions) in a vicinity of an existing (legacy) luminaire. Such a luminaire system may be configured for both inside and outside applications. For outside applications, the modular expansion may be performed while maintaining weathertight sealing integrity, e.g., waterproofing of the luminaire-sensor system and/or apparatus including exterior housing, exterior electrical connections, cables and any other exposed components. The embodiments described herein can provide diverse sensor capability and future expansion needs for luminaire mounted sensing systems and for processing sensor signals.

It is noted that the passage "attached in a vicinity of a luminaire" for the purposes of the present invention can be broadly interpreted to mean directly attached to the luminaire or luminaire system, or alternatively attached and/or affixed in a close proximity, such as up to approximately one foot, to the luminaire (luminaire system).

According to some embodiments, a luminaire-sensor system (or an apparatus) before modular expansion described herein, may include an original luminaire having an exterior housing (e.g., waterproof for outside applications) facilitating at least one electrical luminaire connector (e.g., having a waterproof seal for outside applications), so that the luminaire is configured to provide electrical power to the at least one electrical luminaire connector. The luminaire may include an original (legacy) sensor system that includes one or more original sensors and a corresponding data processing system (for example, see FIG. 8). According to some embodiments, a replaceable exterior sensor module may be used to expand and update the sensing and/or processing capabilities of the luminaire when electrically connected to the luminaire as described herein.

The replaceable exterior sensor module (or for simplicity "external sensor") may include a sensor housing that facilitates at least one electrical sensor connector matched for connecting to the at least one electrical luminaire connector (e.g., by using a complementary universal serial bus (USB)

connector); and one or more sensors, protected by a sensor housing of the replaceable exterior sensor module, and configured to provide one or more corresponding sensor signals. The replaceable exterior sensor module can be configured to be attached at, and detached from, any desired position in the vicinity of the luminaire (i.e., a mechanical interface), and the at least one electrical sensor connector can be configured to be connected to, and disconnected from, the at least one electrical luminaire connector (electrical interface) when the replaceable exterior sensor module is attached at the desired position. Then the replaceable exterior sensor module, when being attached at the desired position with the at least one electrical sensor connector being connected to the at least one electrical luminaire connector, is electrically powered by the luminaire via the at least one electrical sensor connector.

Figure 8:
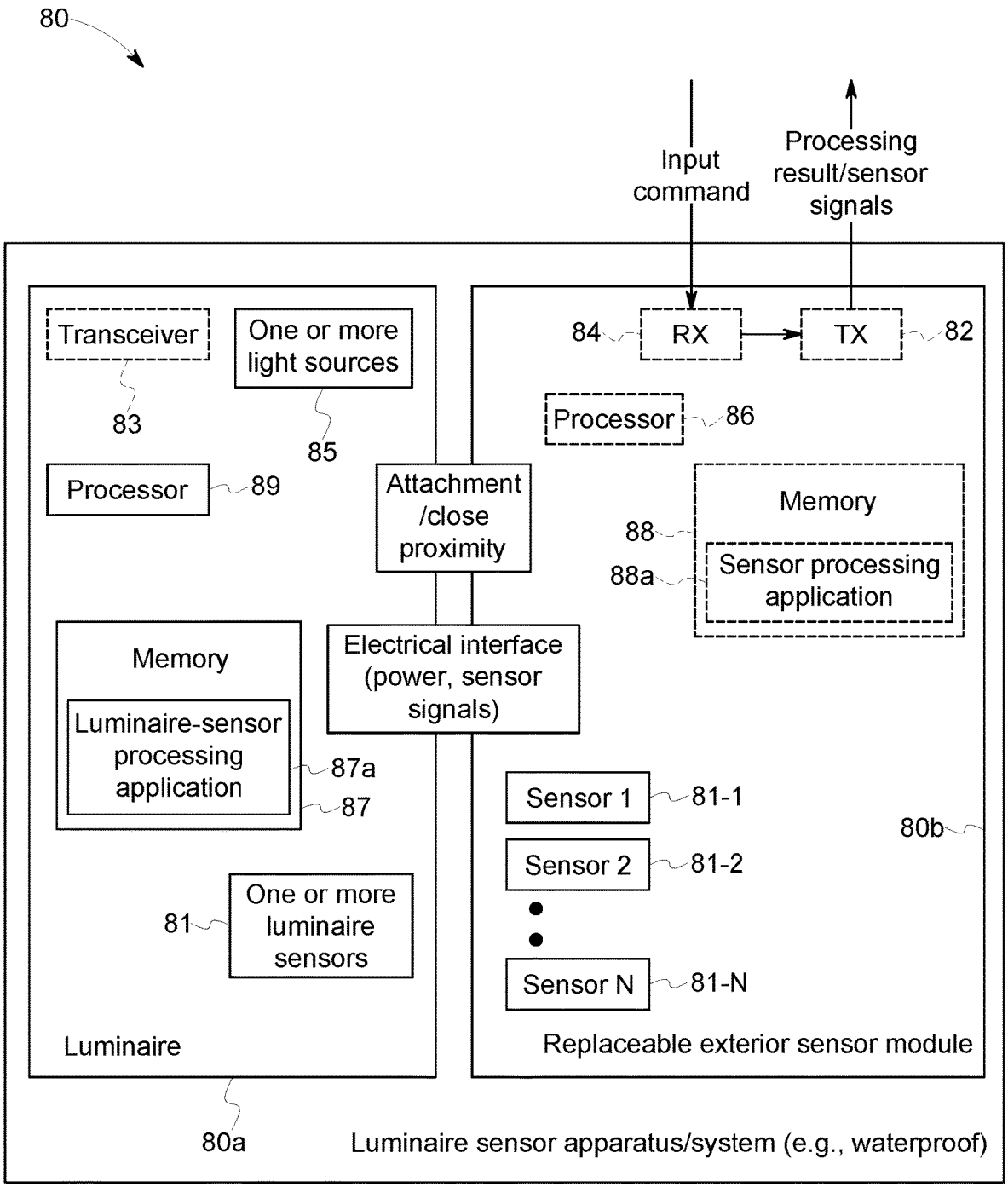
FIG. 8 is an exemplary block diagram of a luminaire-sensor system comprising a luminaire and a replaceable exterior sensor module according to an embodiment of the invention.

According to some further embodiments, the replaceable exterior sensor module may be configured to communicate the corresponding one or more sensor signals to the luminaire for data processing in the luminaire (e.g., using a processor and a memory, as shown in FIG. 8 and explained herein) via the at least one electrical sensor connector which is in a connected state with the electrical luminaire connector. Further, the one or more sensors in the replaceable exterior sensor module may include, but are not limited to, one or more of: a temperature sensor, a pressure sensor, a humidity sensor, a magnetic field sensor, a radiation sensor, a vibration sensor, an acceleration sensor, a lighting detector, a camera, a microphone and a radar device. In an exemplary implementation, the replaceable exterior sensor module may include a circuit board, configured to mount one or more sensors, as further described herein.

According to some alternative embodiments, the replaceable exterior sensor module can include a processor and a memory for data processing of the one or more sensor signals without sending the sensor signals to the luminaire. Such a replaceable exterior sensor module may also include a wireless transmitter for transmitting data of the processed one or more sensor signals to a receiver of another device, and a wireless receiver for receiving appropriate instructions and/or requests, as demonstrated in FIG. 8. In other words, the replaceable exterior sensor module may include be configured to add a processor and a memory for processing the one or more sensor signals, if it was not originally provided. Similarly, the replaceable exterior sensor module may be further configured to add, e.g., a wireless transmitter/receiver pair for sending processed data related to the one or more sensor signals and for receiving pertinent information and/or instructions.

Figure 10A:
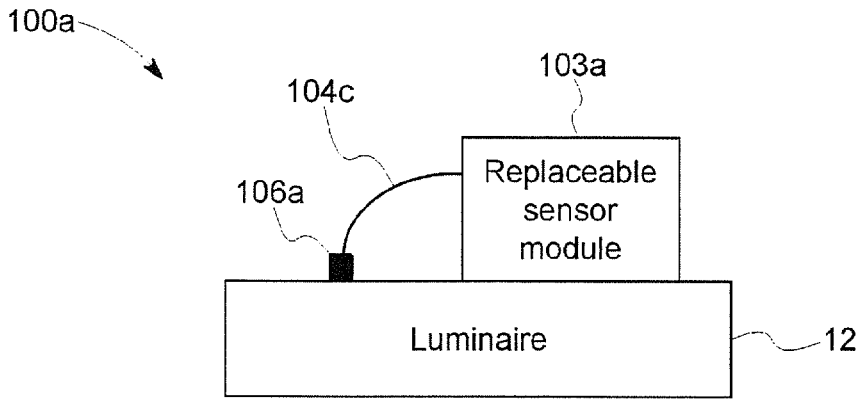
FIGS. 10A-10C are exemplary views of various electrical connecting arrangements, using an electrical cable, of a replaceable exterior sensor module with the luminaire, according to some embodiments of the invention.
Figure 10B:
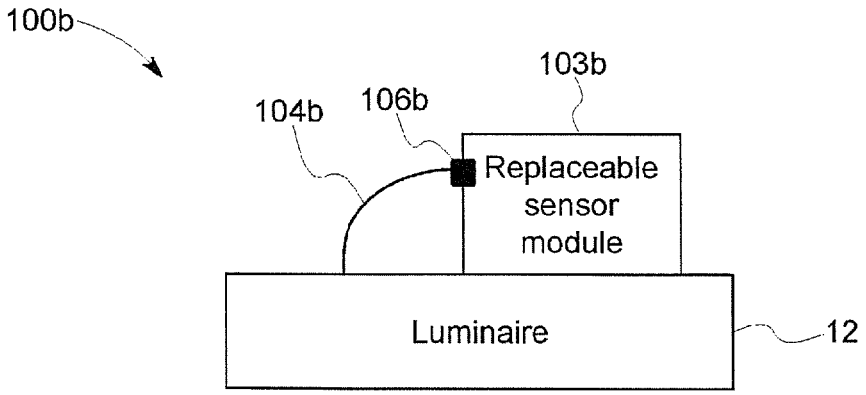
Figure 10C:
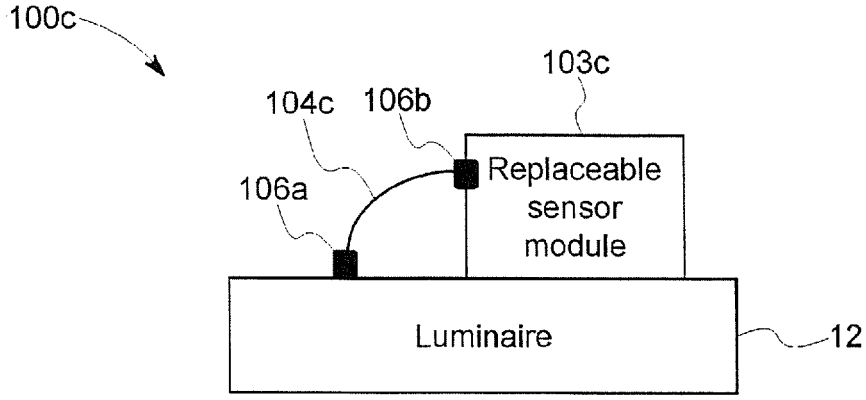

According to some further embodiments, various electrical connecting arrangements can be used (see examples in FIGS. 10A-10C). For example, the at least one electrical sensor connector may be included at a distal end of a wire cable brought out of the sensor housing (e.g., through a gland seal in the case of a waterproof operation) for connecting with the at least one electrical luminaire connector provided in the exterior housing of the luminaire. Alternatively, the at least one electrical luminaire connector can be provided at an end of a wire cable brought out of the exterior housing (e.g., through a gland seal in case of a waterproof operation) for connecting with the at least one electrical sensor connector provided by the sensor housing of the replaceable exterior sensor module. Also, the at least one electrical sensor connector and the at least one electrical luminaire connector may be configured to be connected using a jumper cable using corresponding matching connectors.

Figure 9:
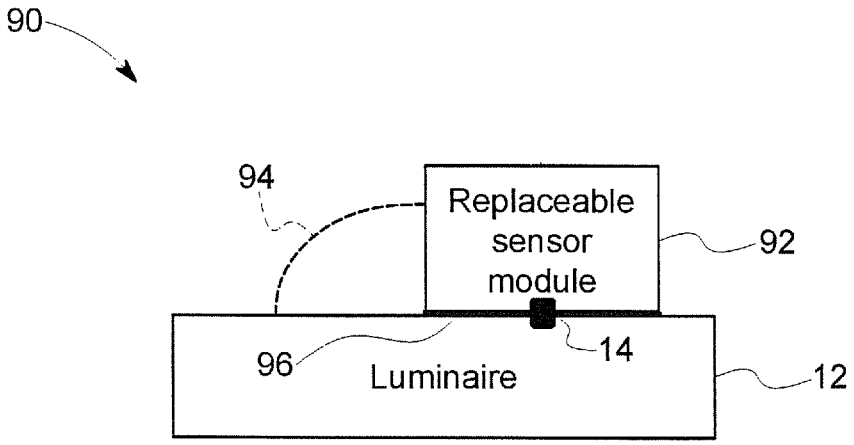
FIG. 9 is an exemplary view of a replaceable (exterior) sensor module shown attached to a luminaire via a direct mechanical interface having more than one electrical line of communication, according to an embodiment of the invention.

It is further noted that the replaceable exterior sensor module and the luminaire may further include additional one or more electrical matched pairs of connectors for establishing additional lines of communication between a replaceable exterior sensor module and the luminaire (see, for example, FIG. 9).

Moreover, in some exemplary embodiments, at least one electrical (external) luminaire connector may have a set of pre-defined electrical and/or mechanical interface characteristics (see, for example, FIGS. 2, 3A, 3B, 4A and 4B). Further, such an electrical luminaire connector can be chosen from a family of standard interfaces, such as RJ-45 (for Ethernet use) or USB (for serial communications). The connector can be also integrated, e.g., into a sealed exterior housing of the luminaire by maintaining the seal integrity of the luminaire sensor system housing. As a result of utilizing a standard sealed connector, a means to mechanically connect the replaceable exterior sensor module (or for simplicity "external sensor") to the at least one electrical luminaire connector can be also provided. The mechanical means may take a form of threaded connections, snaps, twist-locks or other means to attach an item (such as the replaceable exterior sensor module) to the connector interface. This mechanical interface may further incorporate a weathertight sealing method, e.g., using a gasket or O-ring that is engaged when the replaceable exterior sensor module (external sensor) is mated with the external luminaire connector.

Figure 2:
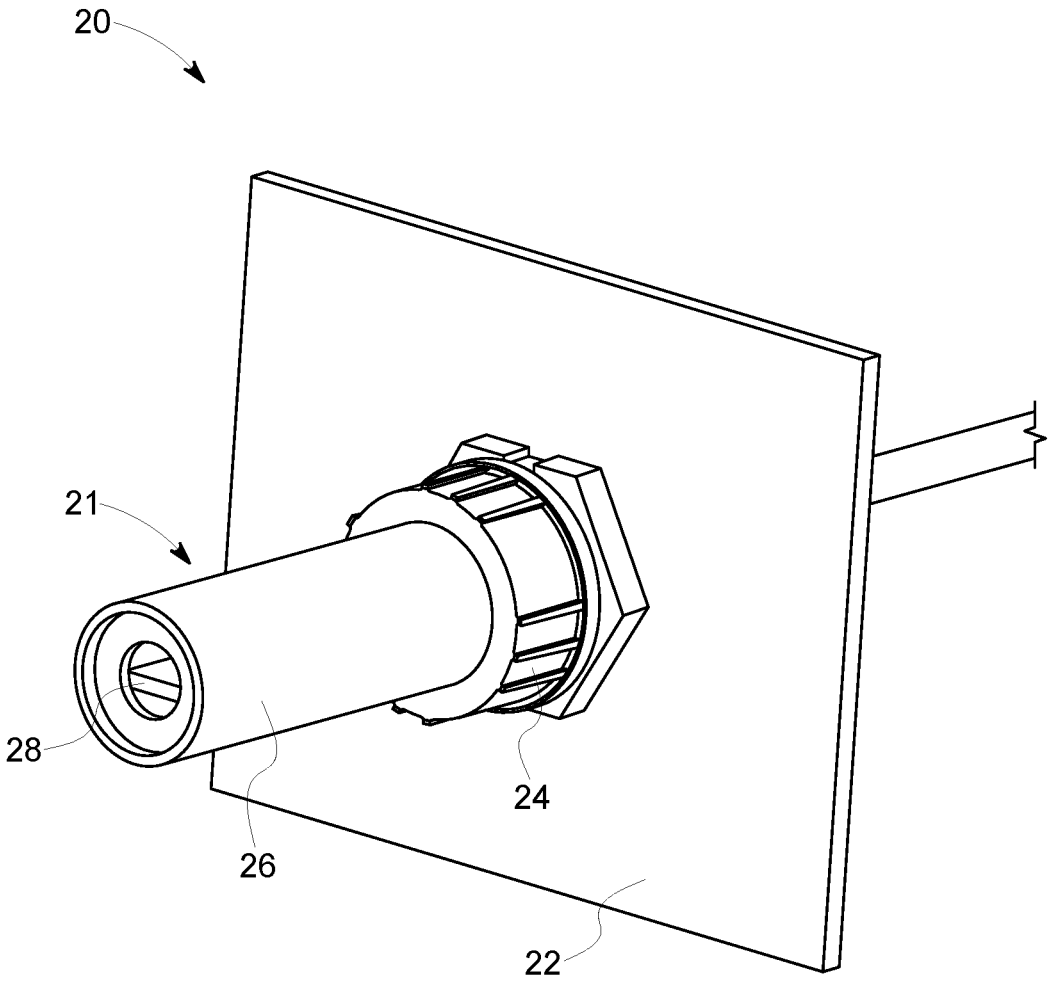
FIG. 2 is a three-dimensional view of an assembly of an external sensor, with a luminaire housing (chassis) which facilitates a luminaire connector, according to an embodiment of the invention.

It is further noted that the mechanical and electrical interfaces like shown in FIGS. 1A, 2, 9 may be overlapping in an area on the exterior housing of the luminaire 12. However, according to further embodiments of the invention, as demonstrated in FIGS. 10A-10C, the mechanical and electrical interfaces can be provided using different exterior housing areas of the luminaire 12.

Furthermore, the mechanical packaging of the external sensor may be constructed from a variety of materials depending upon the application condition (e.g., using a metal such as aluminum, plastic and the like). For example, if it is required for the sensing electronics of the external sensor to be able to sample ambient air in order to detect pressure, humidity or further sound waves, the replaceable external sensor housing can be provided with a gas permeable membrane that will allow for the free exchange of air with the outside environment. Such a membrane may also allow sound waves to enter, while also preventing water (such as from rain due to a thunderstorm) from entering the replaceable exterior sensor module. Suitable gas permeable membranes are offered by the Gore Company GORE-TEX (see, for example, the vent shown in FIG. 7). GORE-TEX vents have desirable properties, including allowing gases to pass easily through their extremely small pores in their expanded polytetrafluoroethylene (ePTFE) structure, while at the same time preventing liquids from passing through due to their high relative surface tension.

If the external sensor is intended to detect magnetic fields, the external sensor housing can be constructed from a material that will not interfere with the magnetic fields, such as plastic or aluminum. In addition, to reduce temperature heating effects of the luminaire for temperature measurements, a plastic material having a low thermal conductivity can be used for the external sensor housing.

Together with the aforementioned standard mechanical interfaces, standard communications protocols can allow for the future expansion of other external sensors and/or modules which utilize common data communication architectures. Utilization of a standard communications protocol can permit or facilitate replacement of external sensors with sensor having different and/or updated capabilities in the future, which can be controlled and utilized by changing the processing software within the processing unit of the replaceable exterior sensor module, in order to provide an expansion interface to the sensor system. This expansion interface can also provide an efficient means to replace an external sensor if it is damaged. Further, it can allow for easy exchange of sensors and interface software of the processing system in the future through the use of a standard mechanical and electrical interface(s).

In summary, the replaceable exterior sensor module is configured to add a sensor or replace any of one or more current sensors. Thus any of the one or more sensors in the replaceable exterior sensor module can include, but not be limited to, any of: a) a type of sensor not presently contained in the luminaire, a) an advanced version of a sensor contained in the luminaire, c) an advanced version of a sensor previously installed in the replaceable exterior sensor module, d) a replacement for a damaged sensor or a repaired sensor in the replaceable exterior sensor module, and e) a novel advanced sensor, which may be based on a new principle of operation.

The figures herein and described below provide non-limiting examples for practicing various embodiments. It is noted that identical or similar parts and/or elements and/or components are designated using the same reference numbers in the various figures.

Figure 1B:
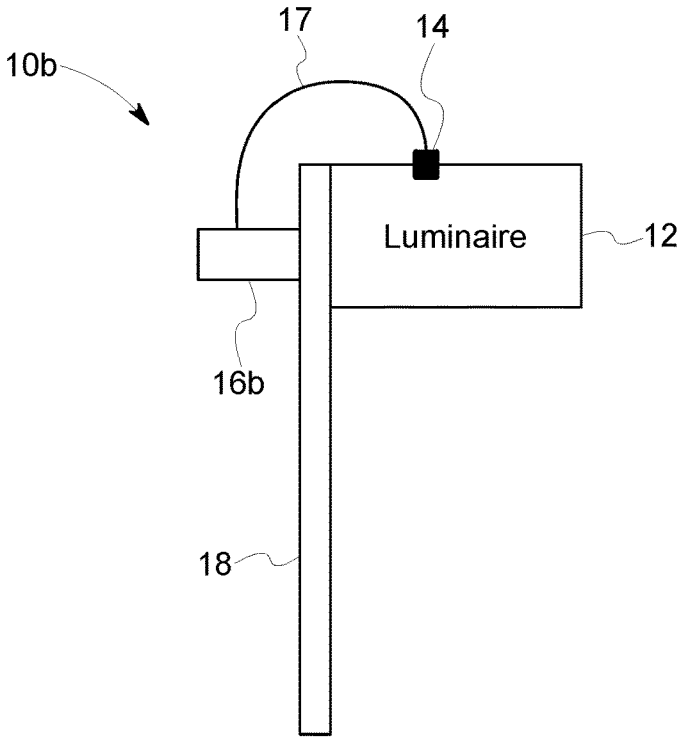

FIGS. 1A-1B are exemplary views 10*a*, 10*b* of a mounting luminaire 12 on a mounting pole 18, which may be powered by an electric cable (not shown), with an added replaceable exterior sensor module 16*a* (in FIG. 1A) and 16*b* (in FIG. 1B), respectively. In FIG. 1A the module 16*a* is directly attached to the luminaire 12 through a mechanical interface (e.g., as shown in FIG. 2), and electrically connected to the luminaire 12 via an electrical connector pair 14, as described herein. The luminaire 12 provides an electrical power to the sensor module 16*a* through the connector pair 14 and further may receive signals from sensors of the replaceable exterior sensor module 16*a* for data processing.

Thus in the exemplary embodiment demonstrated in FIG. 1A, the luminaire 12 can be utilized as a mechanical mounting and an electrical power source for the sensor module 16*a*. It is further noted that the mechanical and electrical interfaces in FIG. 1A are overlapping in the area of attachment on the exterior housing of the luminaire 12. However, according to some embodiments (for example, as shown in FIGS. 10A-10C), the mechanical and electrical interfaces can be provided in different exterior housing areas of the luminaire 12. The mechanical attachment can be facilitated using a variety of conventional methods, including by using fasteners, snaps, locks, connectors and the like, which enable accommodation of various dimensions of the replaceable exterior sensor module 16*a* and the corresponding dimensions of the luminaire 12.

In FIG. 1B, the replaceable exterior sensor module 16*b* is not directly attached to the luminaire 12 (like in FIG. 1A), but instead is attached at a desired position in the vicinity of the luminaire 12, on the mounting pole 18 (e.g., in close proximity of approximately one foot from the connector 14). In this case, the electric interface with the luminaire 12 is provided using a wire cable 17 which is brought out of the sensor housing (which may be by using a gland seal for waterproof outdoor applications), and a connector pair 14 (also provided with a waterproof seal for outdoor applications). Various options for the electric connections are demonstrated in FIGS. 10A-10C.

FIGS. 2, 3A, 3B, 4A, 4B, 5, 6 and 7 are various exemplary views demonstrating expansion of a luminaire's sensing capabilities by providing a mechanical interface/attachment and electrical connection of a replaceable exterior sensor module (also called an "external sensor" herein) to an original luminaire, according to some embodiments. Detailed design features of the external sensor are further provided below.

Figure 3A:
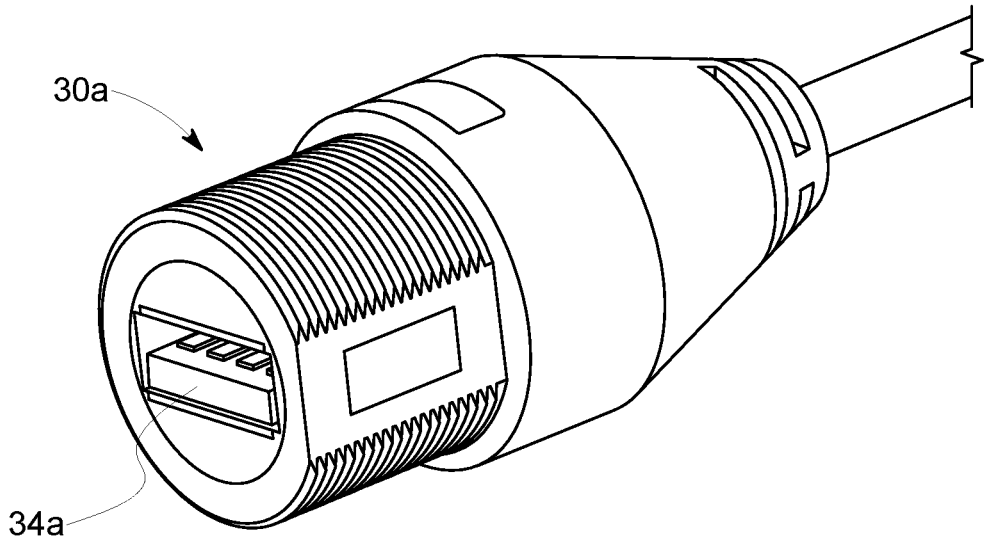
FIGS. 3A and 3B are three-dimensional views of a USB bulkhead connector (FIG. 3A), and of a sealed arrangement for the USB bulkhead connector assembled with a luminaire (FIG. 3B), according to an embodiment of the invention.
Figure 3B:
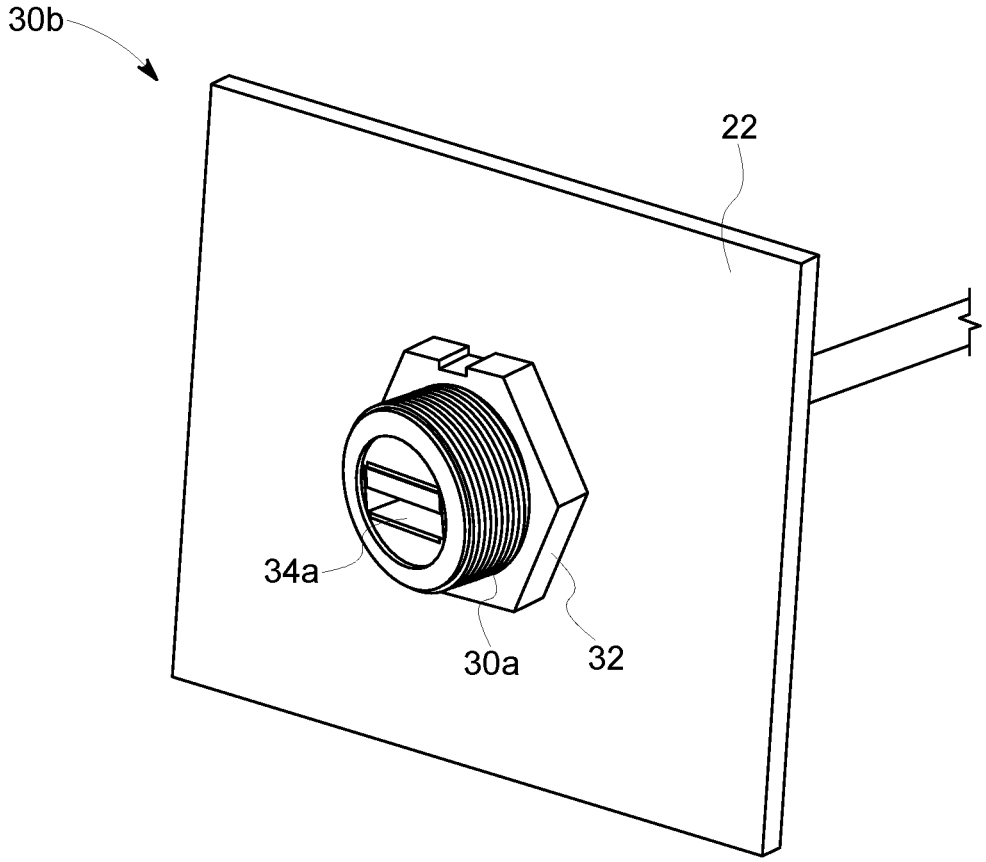

FIG. 2 is a three-dimensional view of an assembly 20 of an external sensor 21, which includes a sensor housing 26, a sensor housing connector or nut 24, and a circuit board assembly 28. Also shown is a luminaire housing (chassis) 22 which facilitates (in an assembly 30*b*, as shown in FIG. 3B) connection via a luminaire connector such as a sealed USB bulkhead connector 30*a* having a USB plug 34*a* (see FIG. 3A). Referring to FIG. 3B, a retention nut 32 can secure and seal the connector 30*a* to the luminaire housing (chassis) 22. The housing nut 24 (FIG. 2) can secure and seal the attached external sensor 21 to the luminaire housing 22.

Figure 4A:
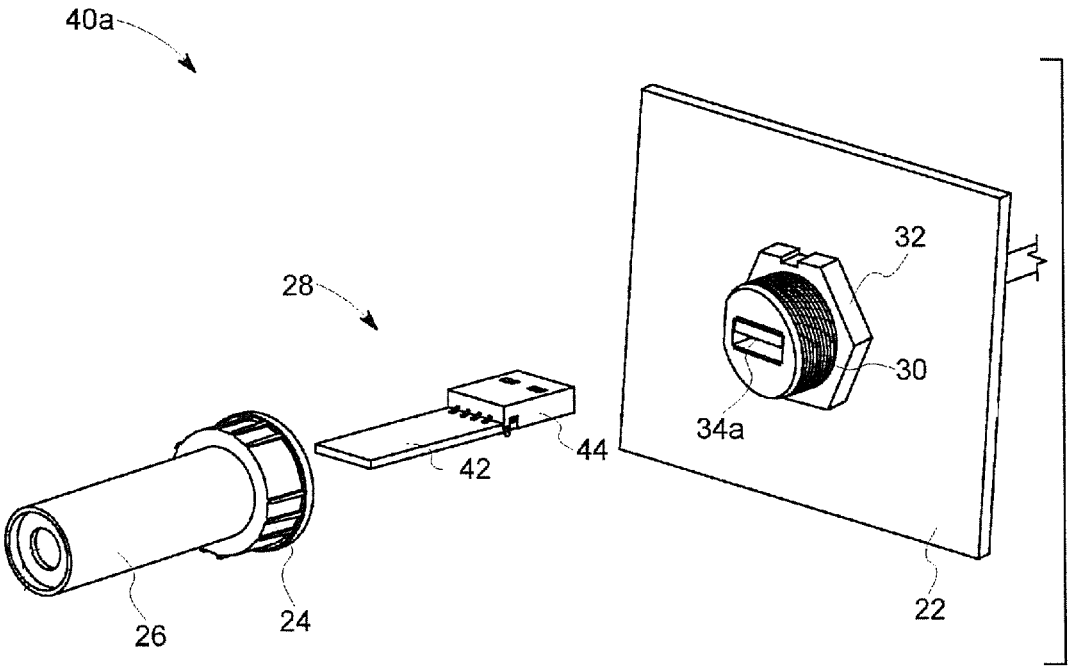
FIGS. 4A and 4B are component specific exploded three-dimensional views for the assembly of FIG. 2, according to some embodiments of the invention.
Figure 4B:
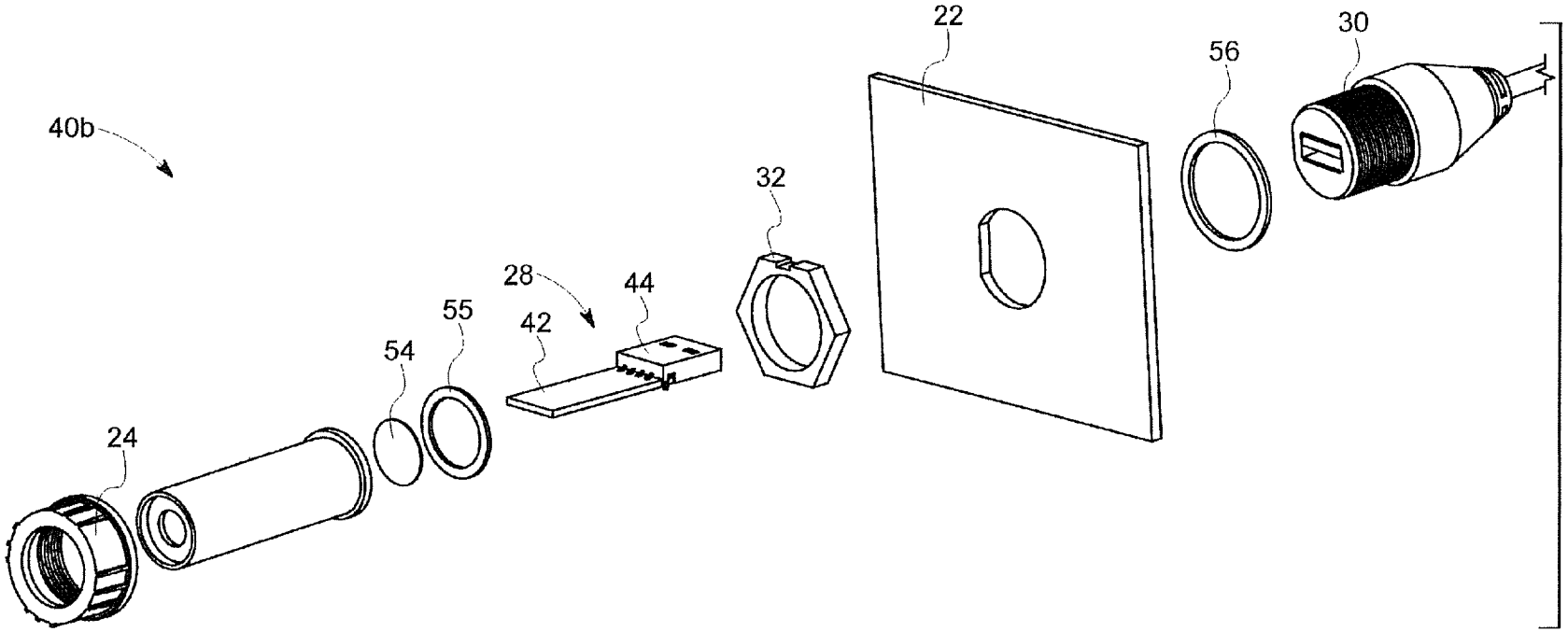

FIGS. 4A and 4B are component specific, exploded three-dimensional views 40*a* and 40*b* of the assembly 20 shown in FIG. 2, according to some embodiments. The circuit board assembly 28 (shown in both FIGS. 4A and 4B) includes a circuit board 42 for accommodating one or more sensors and a USB plug 44 (more details are provided in FIGS. 5 and 6) for connecting to the matching USB plug 34*a*. FIG. 4B shows more components of the external sensor 21. A sensor housing gasket 55 and a luminaire gasket 56 provide a weathertight seal (e.g., a waterproof seal). A membrane 54 (which may be made of GORE-TEX) or vent provides waterproof performance of the external sensor (it prevents water from entering the interior of the external sensor 21), while at the same time providing the free exchange of air and/or sound waves from the outside atmosphere or environment to enter so as to facilitate pressure, humidity and/or acoustic sensor measurements (FIG. 7 illustrates an example membrane).

Figure 5A:
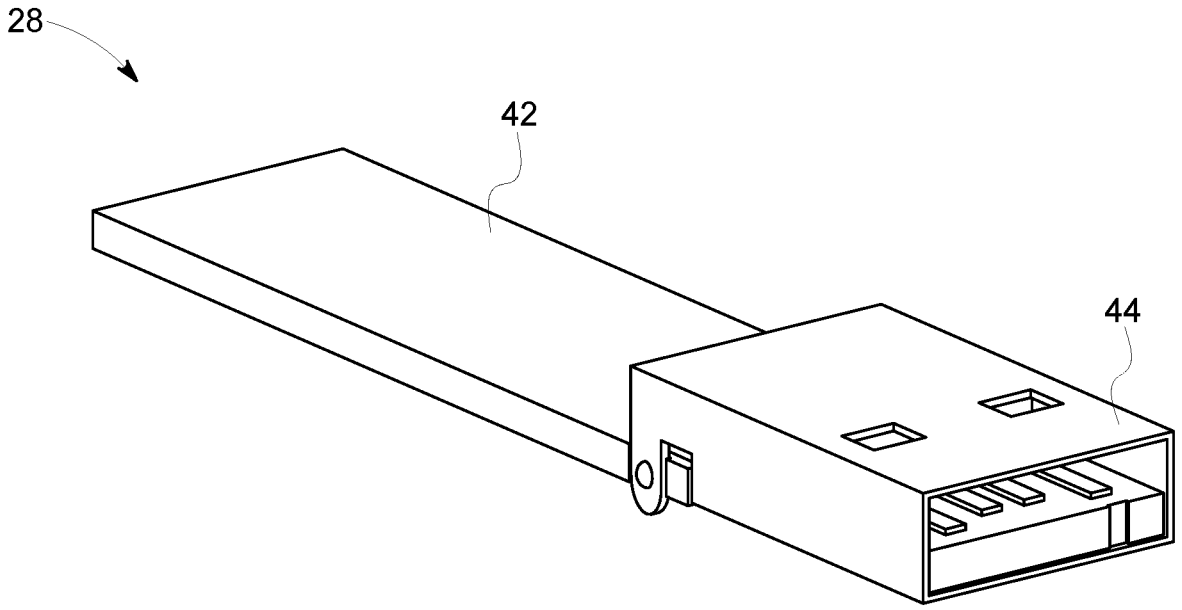
FIGS. 5A and 5B are three-dimensional views of the circuit board assembly for the assembly of FIG. 2, according to an embodiment of the invention.
Figure 5B:
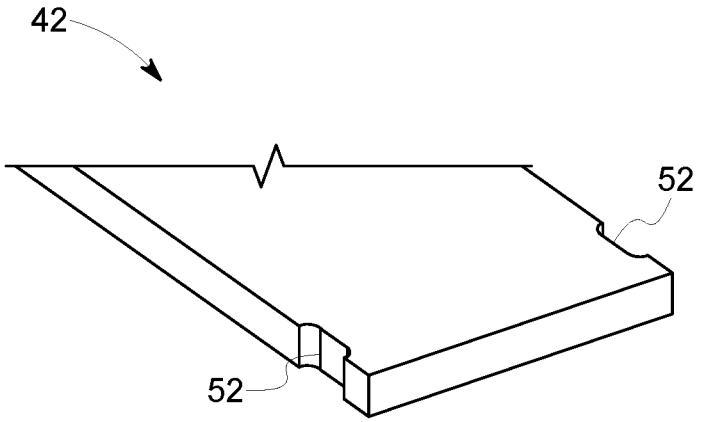

FIGS. 5A and 5B are three-dimensional views of the circuit board assembly 28, according to an embodiment. As stated above in reference to FIGS. 4A and 4B, the circuit board assembly 28 includes a circuit board 42 for placing and/or accommodating one or more sensors (see FIG. 6) and a USB plug 44. As seen from FIG. 5B, the circuit board 42 has castellated portions or notches 52 configured for mating with connectors of the electrical sensor (USB) connector plug 44.

Figure 6:
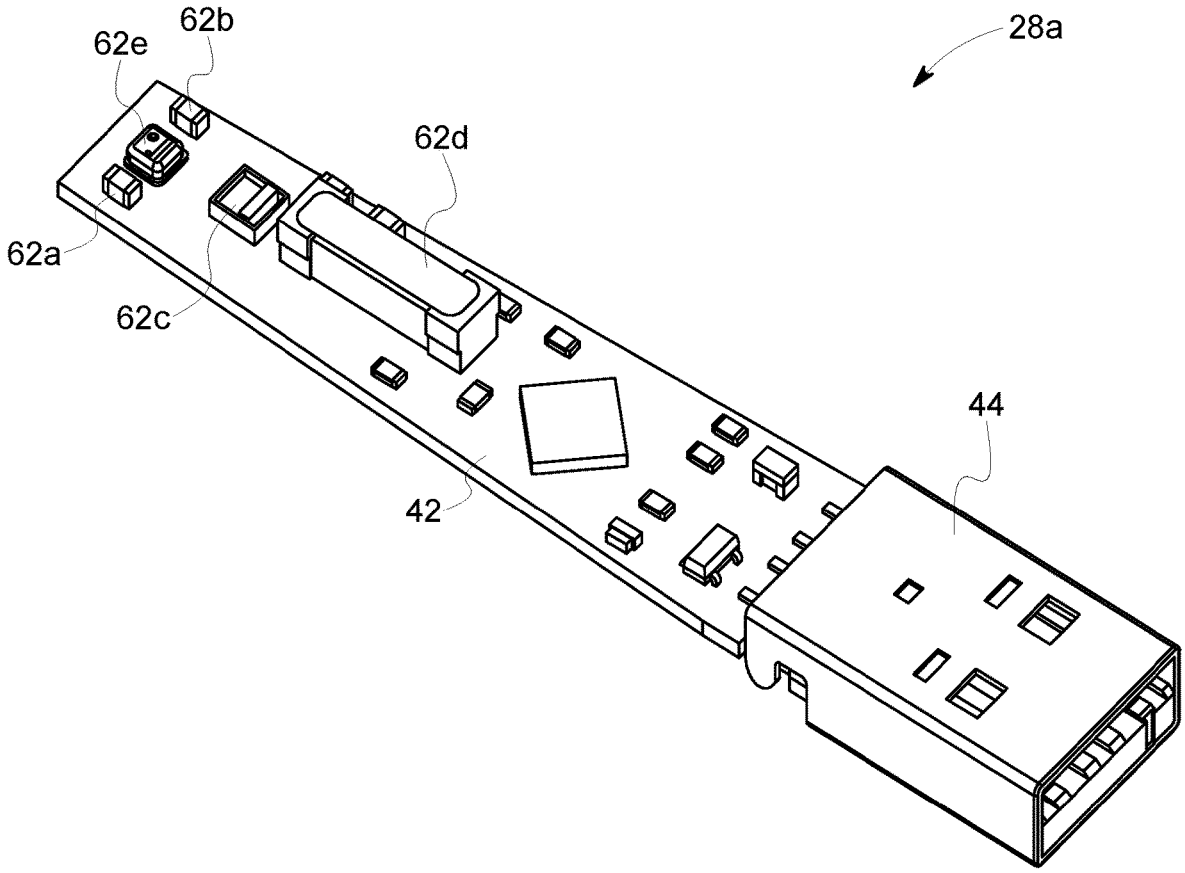
FIG. 6 is an exemplary three-dimensional view of the circuit board assembly of FIGS. 5A and 5B illustrating a plurality of various sensors according to an embodiment of the invention.

FIG. 6 is an exemplary three-dimensional view of the circuit board assembly 28*a* illustrating various sensors accommodated on the circuit board 42. Such sensors can include a temperature sensor 62*a*, humidity and pressure sensors 62*b* and 62*e*, an accelerator sensor 62*c* (for example, an accelerometer), a lighting detector 62*d*, and other types of sensors and/or monitor circuitry. It should be noted that a temperature sensor may be located on a distal end of the circuit board 42 furthest from an exterior housing of the luminaire so as to minimize any temperature effects (heating) that may be caused by energy emitted from operation of the light source of the luminaire.

Figure 7:
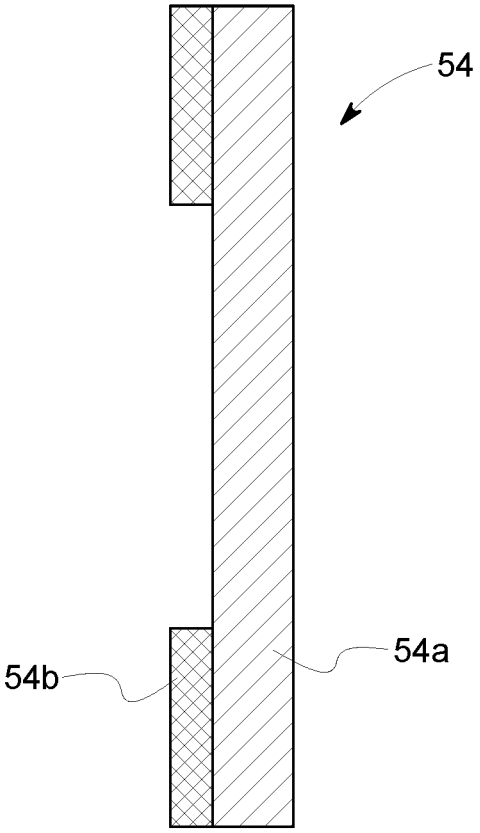
FIG. 7 is a two-dimensional cross-sectional view of a membrane for practicing various embodiments of the invention.

FIG. 7 is a cross-sectional view of a membrane 54 (also shown in FIG. 4B) for practicing some embodiments. The membrane 54 may include an ePTFE membrane portion 54*a* and an adhesive portion 54*b*. The adhesive portion 54*b* can be used to attach the membrane 54, for example, to an internal surface of the sensor housing 26 of the luminaire.

FIG. 8 is an exemplary simplified block diagram of a luminaire-sensor system 80 according to various embodiments. The luminaire-sensor system 80 may include a luminaire 80*a* and a replaceable exterior sensor module 80*b* (an external sensor/apparatus) to expand and/or update the sensing and processing capabilities of the luminaire-sensor system 80. The luminaire 80*a* can be an originally installed device/apparatus (such as a legacy lighting fixture), and the replaceable exterior sensor module/apparatus 80*b* can therefore be added to it to expand and/or improve the sensing or monitoring capabilities of the original lighting system, as described herein.

The luminaire 80*a* can include one or more light sources 85 (e.g., LEDs, fluorescent lamp(s), or the like) and can further provide original sensor capabilities including one or more luminaire sensors 81-1, 81-2, etc. (these sensors can include any sensor from the list provided herein for the replaceable exterior sensor modules). The luminaire 80*a* may also include data processing and/or communication capabilities including a processor 89, a memory 87, a luminaire-sensor processing application 87*a* stored in the memory 87, and a transceiver 83 (wireless or wired, comprising a receiver and a transmitter). The signals provided by the one or more luminaire sensors 81 can be processed by the processor 89 using the luminaire-sensor processing application 87*a*. The generated data (e.g., by processing the original sensor signals) may be transmitted by the transceiver 83 outside of the luminaire 80*a*, and/or may be used internally for managing operation of the luminaire 80*a*.

According to various embodiments described herein, the replaceable exterior sensor module/apparatus (or external sensor/apparatus) 80*b* can be added (in a modular fashion) to the original luminaire 80*a* and can be periodically replaced, as described herein, via an electrical interface (for sharing power, sensor signals and/or generated data), and via a mechanical interface by direct attaching the module/apparatus 80*b* to the luminaire 80*a*, or by attaching it in a desired position in a vicinity of an existing (e.g., legacy) luminaire 80*a* in a close proximity, such as approximately one foot, for both inside and outside applications. The module (device or apparatus) 80*b* can include one or more sensors 81-1, 81-2, . . . , 81-N (wherein "N" is a finite integer). Each sensor may be of a different type, such as a temperature sensor, a pressure sensor, a humidity sensor, a magnetic field sensor, a radiation sensor, a vibration sensor, an acceleration sensor, a lighting detector, a camera, a microphone, a radar and the like. If the module 80*b* does not have data processing capabilities, the collected sensor signals can be sent or transmitted (through the established electrical connection) to the luminaire 80*a* for data processing.

However, if more advanced processing capabilities are available and/or added and/or installed during its operation, according to some embodiments, the module/device 80*b* may include a processor 86, a memory 88, a sensor processing application 88*a* stored in the memory 87, and a transceiver (e.g., wireless), which includes a receiver 84 and a transmitter 82. The signals provided by the sensors 81-1, 81-2, . . . , 81-N can be processed by the processor 86 using the sensor processing application 88*a*. The generated data (and/or original sensor signals) may be provided to the luminaire 80*a* via an electrical interface for managing operation of the luminaire 80*a*, and/or may be transmitted by the transmitter 82 wirelessly from the device 80*b* to an electronic device (such as a central server computer) at another location.

The transmitter 82 and the receiver 84 (also the transceiver 83) may be configured to transmit and receive (e.g., wirelessly) sensor signals and/or related information and data. The transmitter 82 and the receiver 84 may be generally means for transmitting/receiving and may be implemented as a transceiver (e.g., a wireless transceiver), or a structural equivalent thereof.

Various embodiments of the memories 88 and 87 (e.g., computer readable memory) may include any data storage technology type which is suitable to the local technical environment, including but not limited to: semiconductor based memory devices, magnetic memory devices and systems, optical memory devices and systems, fixed memory, removable memory, disc memory, flash memory, DRAM, SRAM, EEPROM and the like. Various embodiments of the processor 86 or 89 include but are not limited to: general purpose computers, special purpose computers, microprocessors, digital signal processors (DSPs), multi-core processors, embedded, and System on Chip (SoC) devices.

The processing application 88*a* or 87*a* may provide various instructions for data processing and interpretation of the sensor signals as described herein. The module 88*a* or 87*a* may be implemented as an application computer program stored in the memory 88 or 87 respectively, but in general it may be implemented as software, firmware and/or a hardware module, or a combination thereof. In particular, in the case of software or firmware, one embodiment may be implemented using a software related product such as a computer readable memory (e.g., non-transitory computer readable memory), computer readable medium or a computer readable storage structure comprising computer readable instructions (e.g., program instructions) using a computer program code (i.e., the software or firmware) thereon to be executed by a computer processor.

FIG. 9 is an exemplary view of a replaceable (exterior) sensor module 92, which may be directly attached to a luminaire 12 via a direct mechanical interface 96 and electrically connected to the luminaire 12 via an electrical interface (connector pair) 14. It may further include one or more electrical pairs of connectors for establishing additional lines of communication between the replaceable exterior sensor module 92 and the luminaire 12. A dotted line 94 indicates at least one more electrical connection line which can be implemented using one of approaches shown in FIGS. 10A-10C.

FIGS. 10A-10C are exemplary views of various electrical connecting arrangements, using an electrical wire cable, of a replaceable exterior sensor module with the luminaire 12 (which may be mechanically directly attached, or being attached in a close proximity as described herein). It is further noted in reference to examples of FIGS. 10A-10C, that if a direct attachment is used to provide the mechanical interface between the replaceable exterior sensor module and the luminaire 12, the electrical interface area in luminaire 12 does not overlap with the area in the luminaire 12 used for the direct mechanical interface.

In FIG. 10A, the at least one electrical sensor connector may be provided at a distal end of a wire cable 104*a* brought out of the sensor housing of the replaceable exterior sensor module 103*a* (e.g., through a gland seal in case of a waterproof operation) for connecting with the at least one electrical luminaire connector provided by the exterior housing of the luminaire 12 by forming, using a corresponding connector pair, an electrical interface 106*a*.

Alternatively, in FIG. 10B, the at least one electrical luminaire connector can be provided at an end of a wire cable 104*b* brought out of the exterior housing of the luminaire 12 (e.g., through a gland seal in case of a waterproof operation) for connecting with the at least one electrical sensor connector provided by the sensor housing of the replaceable exterior sensor module 103*b* by forming, using a corresponding connector pair, an electrical interface 106*b*.

Also, as shown in FIG. 10C, the at least one electrical sensor connector and the at least one electrical luminaire connector may be configured to be connected using a jumper cable 104*c* with corresponding matching connector interfaces 106*a* and 106*b*, described herein.

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus claimed, specific terminology is employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications. Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

What is claimed is:

1. A luminaire-sensor system, comprising:

a luminaire having an exterior housing facilitating at least one electrical luminaire connector, the luminaire is configured to provide an electrical power to the at least one electrical luminaire connector: and a replaceable exterior sensor module configured to expand and update sensing capabilities of the luminaire when electrically connected to the luminaire, and comprising:

a sensor housing facilitating at least one electrical sensor connector matched for connecting to the at least one electrical luminaire connector; and one or more sensors, protected by the sensor housing of the replaceable exterior sensor module, and configured to provide corresponding one or more sensor signals, wherein the replaceable exterior sensor module is configured to be attached at and detached from a desired position in a vicinity of the luminaire, and wherein the at least one electrical luminaire connector is facilitated at an end of a wire cable brought out of the exterior housing for connecting with the at least one electrical sensor connector facilitated by the sensor housing of the replaceable exterior sensor module, and the at least one electrical sensor connector is configured to be connected to and disconnected from the at least one electrical luminaire connector when the replaceable exterior sensor module is attached at the desired position, so that the replaceable exterior sensor module, when being attached at the desired position with the at least one electrical sensor connector being connected to the at least one electrical luminaire connector, is electrically powered by the luminaire via the at least one electrical sensor connector.

2. The luminaire-sensor system of claim 1, wherein the replaceable exterior sensor module is attached directly to the luminaire.

3. The luminaire-sensor system of claim 1, wherein the luminaire-sensor system, including any external electrical connections, is waterproof.

4. The luminaire-sensor system of claim 1, wherein, the replaceable exterior sensor module is configured to communicate the corresponding one or more sensor signals to the luminaire for data processing via the at least one electrical sensor connector which is connected with the at least one electrical luminaire connector of the luminaire.

5. The luminaire-sensor system of claim 1, wherein the at least one electrical sensor connector and the at least one electrical luminaire connector comprise complementary universal serial bus (USB) connectors.

6. The luminaire-sensor apparatus of claim 1, wherein the replaceable exterior sensor module comprises a circuit board, configured to accommodate one or more sensors.

7. The luminaire-sensor system of claim 6, wherein the circuit board has castellated holes for attaching the at least one electrical sensor connector comprising a universal serial bus (USB) plug.

8. The luminaire-sensor system of claim 1, wherein the one or more sensors include at least one or more of: a temperature sensor, a pressure sensor, a humidity sensor, a magnetic field sensor, a radiation sensor, a vibration sensor, an acceleration sensor, a lighting detector, a camera, a microphone and a radar.

9. The luminaire-sensor system of claim 1, wherein the replaceable exterior sensor module comprises a membrane which is waterproof but substantially transparent to an air and sound waves, the membrane is configured to facilitate a waterproof operation of the replaceable exterior sensor module, and an operation of any of a pressure sensor, a humidity sensor and a microphone.

10. The luminaire-sensor system of claim 1, wherein the replaceable exterior sensor module is configured to add a processor, a memory and a corresponding application stored in the memory, to process the one or more sensor signals.

11. The luminaire-sensor system of claim 10, wherein the replaceable exterior sensor module is further configured to add a wireless transmitter for sending processed data for the one or more sensor signals.

12. The luminaire-sensor system of claim 1, wherein the luminaire comprises one or more original sensors, so that the one or more sensors in the replaceable exterior sensor module are complementary to the one or more original sensors in the luminaire.

13. The luminaire-sensor system of claim 1, wherein the replaceable exterior sensor module and the luminaire further comprise additional one or more electrical matched pairs of connectors for establishing additional lines of communication.

14. The luminaire-sensor system of claim 1, wherein the sensor housing comprises a plastic material.

15. A luminaire-sensor system, comprising:

a luminaire having an exterior housing facilitating at least one electrical luminaire connector, the luminaire is configured to provide an electrical power to the at least one electrical luminaire connector; and a replaceable exterior sensor module configured to expand and update sensing capabilities of the luminaire when electrically connected to the luminaire, and comprising:

a sensor housing facilitating at least one electrical sensor connector matched for connecting to the at least one electrical luminaire connector; and one or more sensors, protected by the sensor housing of the replaceable exterior sensor module, and configured to provide corresponding one or more sensor signals, wherein the replaceable exterior sensor module is configured to be attached at and detached from a desired position in a vicinity of the luminaire, and wherein the at least one electrical sensor connector and the at least one electrical luminaire connector are configured to be connected using a jumper cable with corresponding matching connectors so that the at least one electrical sensor connector is configured to be connected to and disconnected from the at least one electrical luminaire connector when the replaceable exterior sensor module is attached at the desired position, so that the replaceable exterior sensor module, when being attached at the desired position with the at least one electrical sensor connector being connected to the at least one electrical luminaire connector, is electrically powered by the luminaire via the at least one electrical sensor connector.

16. The luminaire-sensor system of claim 15, wherein the at least one electrical sensor connector and the at least one electrical luminaire connector comprise complementary universal serial bus (USB) connectors.

17. The luminaire-sensor system of claim 15, wherein the replaceable exterior sensor module comprises a membrane which is waterproof but substantially transparent to an air and sound waves, the membrane is configured to facilitate a waterproof operation of the replaceable exterior sensor module, and an operation of any of a pressure sensor, a humidity sensor and a microphone.

18. The luminaire-sensor system of claim 15, wherein the replaceable exterior sensor module is configured to add a processor, a memory and a corresponding application stored in the memory, to process the one or more sensor signals.

19. The luminaire-sensor system of claim 15, wherein the luminaire comprises one or more original sensors, so that the one or more sensors in the replaceable exterior sensor module are complementary to the one or more original sensors in the luminaire.

20. The luminaire-sensor system of claim 15, wherein the replaceable exterior sensor module and the luminaire further comprise additional one or more electrical matched pairs of connectors for establishing additional lines of communication.

21. An apparatus, comprising:

a replaceable exterior sensor module configured to expand and update sensing capabilities of a luminaire when electrically connected to the luminaire, and comprising:

a sensor housing facilitating at least one electrical sensor connector matched for connecting to at least one electrical luminaire connector facilitated by an exterior housing of the luminaire, wherein the at least one electrical luminaire connector is facilitated at an end of a wire cable brought out of the exterior housing for connecting with the at least one electrical sensor connector facilitated by the sensor housing of the replaceable exterior sensor module; and one or more sensors, protected by the sensor housing of the replaceable exterior sensor module, and configured to provide corresponding one or more sensor signals, wherein the replaceable exterior sensor module is configured to be attached at and detached from a desired position in a vicinity of the luminaire, and the at least one electrical sensor connector is configured to be connected to and disconnected from the at least one electrical luminaire connector when the replaceable exterior sensor module is attached at the desired position, so that the replaceable exterior sensor module, when being attached at the desired position with the at least one electrical sensor connector being connected to the at least one electrical luminaire connector, is electrically powered by the luminaire via the at least one electrical sensor connector.

22. The apparatus of claim 21, wherein the replaceable exterior sensor module is attached directly to the luminaire forming a combined waterproof system.

* * * * *